US008033339B2

(12) United States Patent
Williams

(10) Patent No.: US 8,033,339 B2
(45) Date of Patent: Oct. 11, 2011

(54) AROUND-THE-PUMP ADDITIVE SYSTEM FOR INDUSTRIAL SCALE FIRE HAZARDS

(75) Inventor: Dwight Williams, Vidor, TX (US)

(73) Assignee: Williams Fire & Hazard Control, Inc, Vidor, TX (US)

( * ) Notice: Subject to any disclaimer, the term of this patent is extended or adjusted under 35 U.S.C. 154(b) by 2486 days.

(21) Appl. No.: 10/081,419

(22) Filed: Feb. 22, 2002

(65) Prior Publication Data

US 2003/0159835 A1 Aug. 28, 2003

(51) Int. Cl.
*A62C 2/00* (2006.01)

(52) U.S. Cl. ..... 169/47; 169/46; 169/5; 169/13; 169/15; 169/24; 169/54; 169/66

(58) Field of Classification Search ..... 169/5, 13–15, 169/24, 52, 54, 66–67, 46, 47; 239/310, 239/318, 722, 724, 124; 137/565.22, 565.29, 137/98, 896

See application file for complete search history.

(56) References Cited

U.S. PATENT DOCUMENTS

| | | | | | |
|---|---|---|---|---|---|
| 4,234,044 | A * | 11/1980 | Hollan et al. | ..... | 169/14 |
| 4,246,969 | A * | 1/1981 | McLoughlin et al. | ..... | 169/13 |
| 4,324,294 | A * | 4/1982 | McLoughlin et al. | ..... | 169/13 |
| 4,503,915 | A * | 3/1985 | Gagliardo et al. | ..... | 169/15 |
| 5,174,383 | A * | 12/1992 | Haugen et al. | ..... | 169/15 |
| 5,398,765 | A * | 3/1995 | Worthington | ..... | 169/52 |
| 5,419,497 | A * | 5/1995 | Warrington | ..... | 169/52 |
| 5,797,421 | A * | 8/1998 | Merrett | ..... | 169/24 |
| 5,829,533 | A * | 11/1998 | Williams | ..... | 169/66 |
| 6,138,767 | A * | 10/2000 | La Vergne | ..... | 169/15 |
| 6,401,829 | B1 * | 6/2002 | Newton | ..... | 169/24 |

* cited by examiner

*Primary Examiner* — Steven J Ganey

(74) *Attorney, Agent, or Firm* — Sue Z. Shaper; Sue Z. Shaper, P.C.

(57) ABSTRACT

Fire fighting method and apparatus including pumping at least 2000 gpm water from large water reservoir toward an industrial hazard and adding, in an around-the-pump system, at least one water additive from a source to the pumped water through a fitting established on the suction side of the pump, the fitting in fluid communication between the reservoir outlet and the suction side.

17 Claims, 4 Drawing Sheets

AROUND-THE-PUMP ADDITIVE SYSTEM FOR INDUSTRIAL SCALE FIRE HAZARDS

FIELD OF THE INVENTION

The invention relates to methods and apparatus for combining additive with water in an industrial scale fire fighting system. The invention relates to improved methods and apparatus for the supply of foam concentrate additive, in particular, to water delivered from a large reservoir.

BACKGROUND OF THE INVENTION

In industrial applications, such as tank farms, the source of fire fighting fluid is frequently water drawn from a lake or a moat or a tank or a pond or the like, even from the ocean, (such sources will be referred to herein generically as a reservoir.) The reservoir is contained frequently by or within man-made dikes. Typically, water is supplied through a pipe extending out of a lower portion of a dike, or by a pipe extending over a dike, the pipe usually having some valved outlet with fittings.

A reservoir typically provides water under some pressure for fire fighting purposes. However, in almost all circumstances, even though the water may flow from a reservoir under some natural pressure, a pump is utilized to supply the necessary gallonage of water to the fire fighting conduits at a constant, predictable, design pressure, such as 150 psi.

In the instant application the pump and the source of water are both assumed to be of large scale. For instance, they may be of a scale to supply 40,000 gallons of water per minute to a hazard. Pumps utilized in such applications (including pump combinations) should be capable of at least supplying 2000 gpm water at the requisite pressure.

It is usually desired to mix an additive, such as a foam concentrate, into the water that is in transit from a reservoir to a hazard to fight fire. Typically in these applications an around-the-pump system is used for this addition. Around-the-pump systems traditionally entail bringing to a reservoir/hazard area a tank or source of additive, such as a foam concentrate, as well as a pump suitable not only for pressuring the water but also specially fitted with an "around-the-pump" additive supply inlet. This around-the-pump additive supply inlet links to an additive source on a suction side of the pump. On the discharge side pump output is siphoned off and routed around the pump back to its suction side, picking up, in transit, an appropriately metered amount of additive. Usually a jet pump is employed to help extract the additive from the additive source and into the around-the-pump lines. Water rich with foam concentrate is in such manner delivered to the suction side of the pump.

Pumps designed to function in an around-the-pump system are designed with, or are modified to have, an inlet on their suction side to support an around-the-pump line. This is typically a 2½ inch line.

It would be advantageous, however, in an emergency to be able to utilize standard pumps for an around-the-pump system. Standard pumps, of the requisite size but not fitted with special around-the-pump inlets, could be more easily and quickly found and set up on location at an industrial facility than specially fitted pumps. A system utilizing standard pumps could avoid the cost and loss of time involved in having to bring to a hazard a pump specially fitted with a suction side inlet in order to be able to operate an around-the-pump system.

The instant invention teaches and discloses a novel system, including methods and apparatus, for establishing an around-the-pump supply of additive to water from a large reservoir using standard pumps. The novel system does not require finding a pump already fitted with an appropriate around-the-pump suction side inlet. In the instant invention fittings are used, which can be pre-installed or brought to the reservoir and hazard area, such that together with a source of additive and appropriate hoses or lines, they can establish an effective around-the-pump supply of additive to water drawn from a large reservoir using an appropriately sized standard pump.

SUMMARY OF THE INVENTION

The instant invention comprises a fire fighting system that includes pumping at least 2000 gallons per minute of water from a large water reservoir toward an industrial hazard and adding, in an around-the-pump system, at least one water additive from a source to the pumped water. The water additive is added through a fitting established on a suction side of the pump, the fitting at least initially separate from the pump and in fluid communication between a reservoir outlet and the suction side.

The invention includes apparatus for a fire fighting system, the apparatus including a large water reservoir, a 2000 or greater gpm pump, a source of water additive and a separate fitting attached between, and adapted for fluid communication with, a reservoir outlet and a suction side of the pump and also an additive source and a suction side of the pump.

The invention includes a large water reservoir, a 2000 or greater gpm pump, a source of water additive and means separate from the pump for connecting an around-the-pump additive supply line with a suction side of the pump.

BRIEF DESCRIPTION OF THE DRAWINGS

A better understanding of the present invention can be obtained when the following detailed description of the preferred embodiments are considered in conjunction with the following drawings, in which.

The figures are illustrative. They are not drawn to scale, as would be clear to one of ordinary skill in the art.

DESCRIPTION OF PREFERRED EMBODIMENTS

"Hazard" as used herein is intended to include potential hazards, such as potential sources of fire or explosion. "Pump" as used herein should be understood to include one or more pumps or pump combinations. "Reservoir" as used herein should be understood to refer to one or more reservoirs or to some reservoir combination, and includes moats, ponds, lakes, tanks, even an ocean. "Large" as used herein to modify reservoir can be said to indicate 50,000 gallons or more capacity. One typical water additive is foam concentrate.

It might be noted at the outset that frequently water is supplied from a reservoir outlet to a pump, and from a pump to a facility conduit, using manifolds and a plurality of hoses, rather than using just one large line or hose. The use of a plurality of hoses makes the system more amendable to human handling, but it is not essential.

Note also that the industrial facility conduits for water and additive frequently include fixed conduits, or pipes, at least in part. However, the system could operate entirely with moveable hoses, one line or a plurality of lines.

Figure 1:
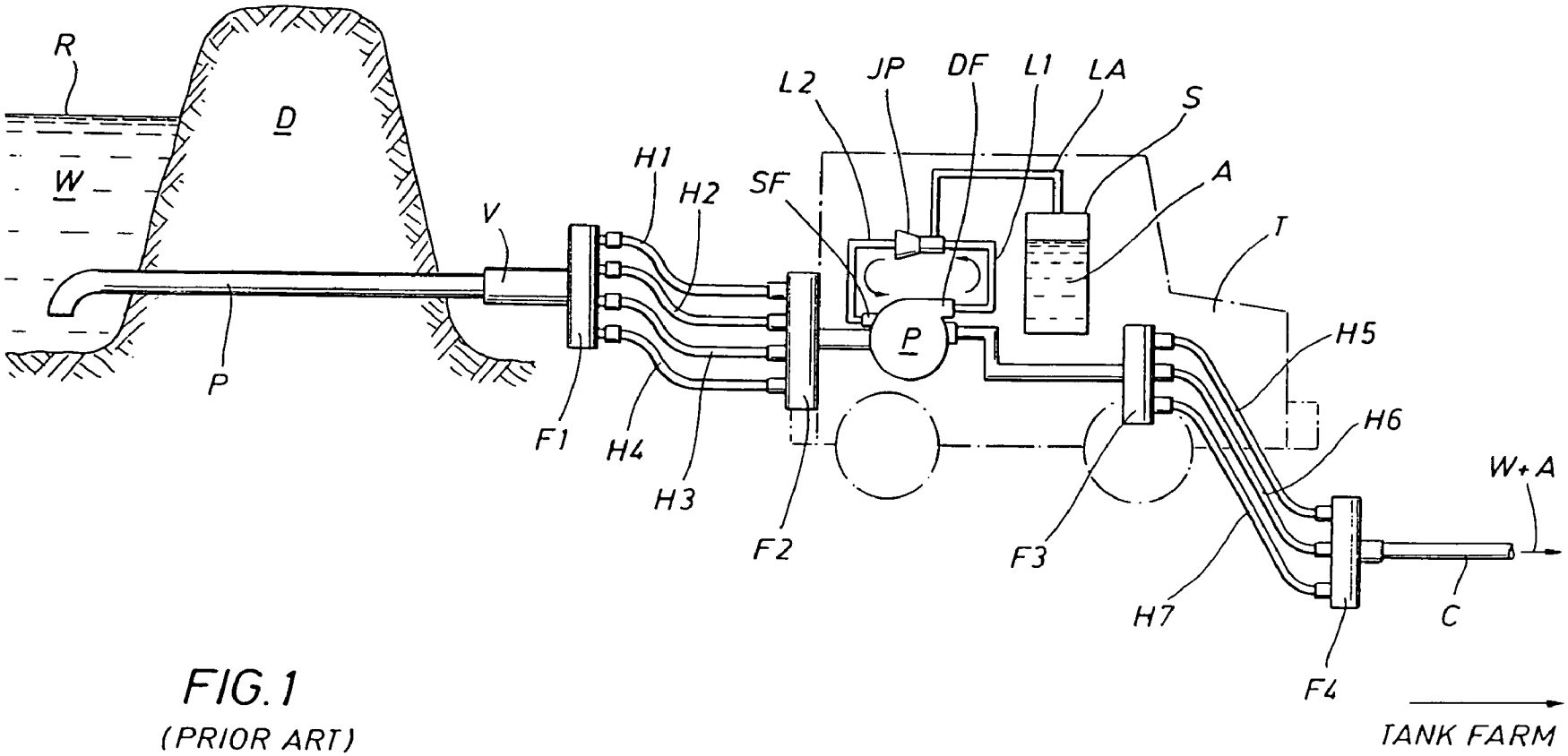
FIG. 1 (PRIOR ART)
FIG. 1 illustrates a typical embodiment of present practice.

Discussing in general the apparatus and application of current practice illustrated in FIG. 1, water W and additive A exit the apparatus at the right of the drawing through conduit C. It is presumed that the water and additive are being piped by conduit or line C toward some hazard at an industrial facility, such as a tank farm.

Water W originates on the left of the drawing of FIG. 1 at reservoir R, shown contained in part by earthen dam D. Pipe P as shown draws water out of the reservoir through the bottom of earthen dam D, a common practice although not of course necessary. A variety of means could be available to draw water out of reservoir R.

Pipe P typically terminates in valve V and a fitting F1 attached at or with valve V. The valve and the fitting could be constructed of one piece. Fitting F1, as found today at many facilities, usually provides multiple outlets for the attachment of multiple lines. This is typical but not necessary. Multiple smaller lines are more amenable to human handling than one large line.

Figure 2:
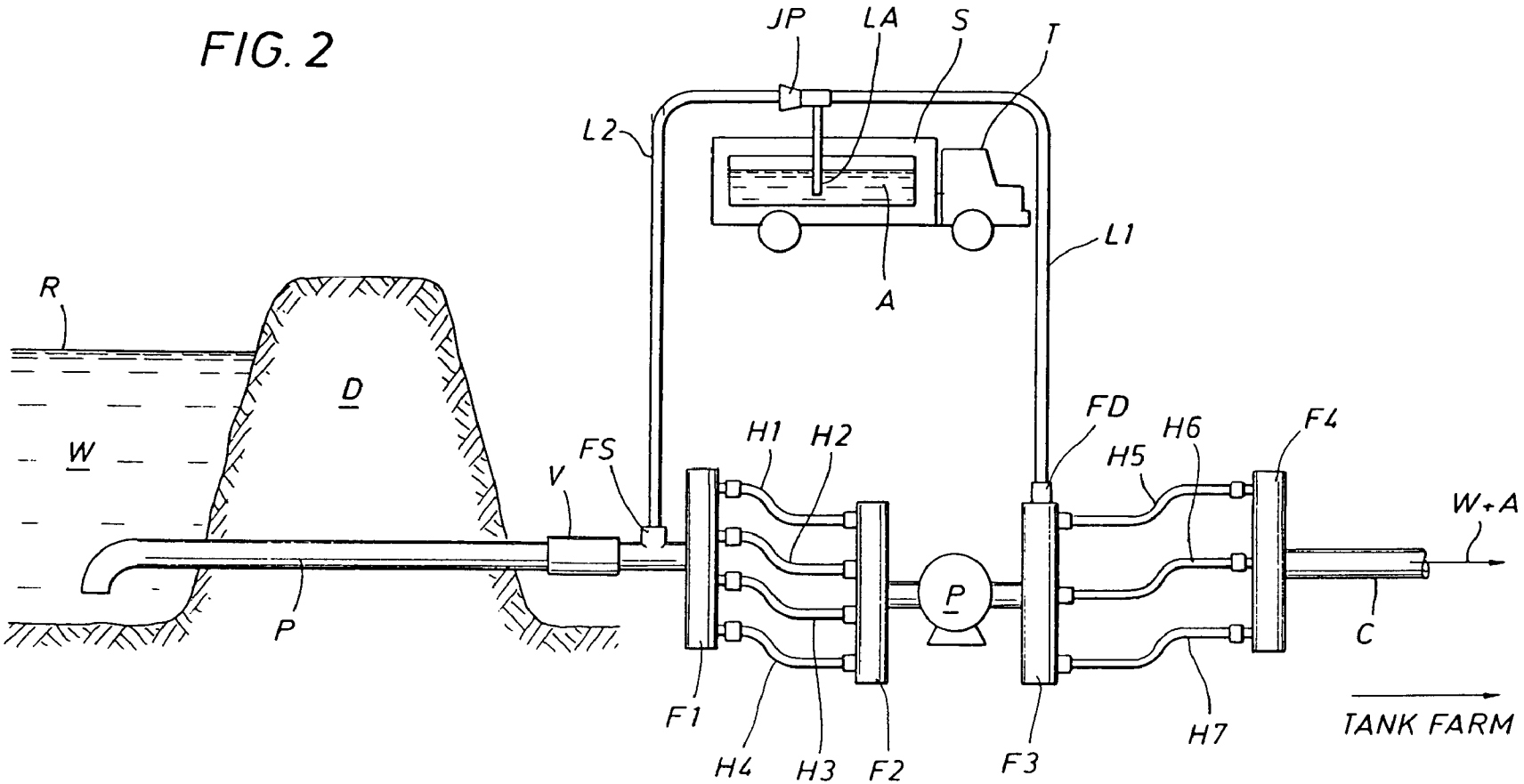
FIG. 2 illustrates a preferred embodiment of the instant invention.

Lines H1, H2, H3 and H4 are illustrated as attached to the outlets provided by fitting F1 in FIGS. 1 and 2. Practically speaking the lines will typically be attached upon the occurrence of some hazardous situation. However, a number of variations might occur in the art as the situation dictates. The lines H1-H4 could be pipe instead of hose and could comprise fixed conduits instead of movable lines.

Conduit C to the right of the drawings is typically a fixed conduit but could be a portable line. Furthermore the conduit could be one or more lines. One conduit C is shown for convenience.

Upon the occurrence of a hazard, which includes potential hazards or threats of hazard, it is desired to deliver water with additive from a reservoir to the conduit or conduits C. The reservoir, of course, could comprise multiple reservoirs or a system of reservoirs. One reservoir is indicated for convenience.

In the process of delivering water from the reservoir to the conduit it is desired to meter in, or proportion in, a requisite amount of additive. Foam concentrate is a paradigmatic water additive added to the water line.

In accordance with prior art practices, additive is added to water from the reservoir through the imposition of, usually, a truck or a trailer carrying a source S of additive A as well as a pump P. The truck or trailer or skid or the like comes equipped with fittings F1 and F3. Fittings F1 and F3 are designed to connect upstream with a line or lines of water running from the reservoir on the one hand, and downstream with a line or lines running to a fitting on the conduit(s) or hose(s) delivering the water and additive throughout the industrial facility.

The pump delivered on the truck or skid or trailer by present practice is fitted for around-the-pump action. The pump plays two functions. On the one hand the pump insures that the water delivered from the reservoir to the conduit is delivered with the requisite pressure, such as 150 psi. On the other hand, the pump is specially fitted for the addition of the additive.

To perform the latter function the pump comes fitted with a special suction side inlet fitting SF, as well as a discharge side outlet fitting DF, both adapted for connecting with around-the-pump sized lines L1 and L2 to construct an around-the-pump loop for water additive. Typically lines L1 and L2 will be 2½ inch hose lines. (Typically the water lines leading in and out of the pump are larger lines.)

In the around-the-pump system a certain amount of discharged water is drawn off through a discharge outlet DF, through line L1, typically a 2½ inch line, through jet pump JP, through line L2 and is returned into a suction side of the pump at special suction side inlet SF. The water, while passing through jet pump JP draws in additive from source S. Use of a jet pump is typical in the application, but of course is not per se necessary. Other means could be used to help supply additive into the around-the-pump lines L1 and L2.

The instant invention, illustrated in FIGS. 2-5, teaches and discloses establishing an around-the-pump system utilizing a standard pump P, a pump without having previously been fitted with a special suction side inlet suitable for attaching an around-the-pump line, such as a 2½ inch line. Standard pump P comes with fittings F2 and F3. F3 typically has a discharge outlet FD suitable for attaching to an around-the-pump line L1. However, the standard pump P suction side typically does not have a suitable inlet for attaching an around-the-pump line L2.

The instant invention teaches preferred and alternate embodiments for providing a fitting to be used with a standard pump P in order to establish an around-the-pump system. In this system a source of additive needs to be provided. This source can be a tank or truck. Typically a jet pump or an analogous mechanism will be provided for helping draw out additive and communicate the additive from the source S into the around-the-pump lines. An advantage of the instant invention, however, is being able to drive up sources of additive and connect them to an around-the-pump system without having to bring in a special pump, but rather by utilizing existing or ready to hand standard pumps of the appropriate size.

In one preferred embodiment a fitting for attaching a suction side line for an around-the-pump system would be established by using a removable or permanent fitting attached to the outlet of a pipe delivering water from a reservoir. This fitting is illustrated as F1 in FIG. 2 and illustrates an inlet attachment FS (such as a 3 inch pipe with mating for a 2½ inch hose) suitable for attaching to a suction side around-the-pump line L2. Fitting F1 of the instant invention could be a permanent feature, installed at a dike on a supply pipe of a reservoir at an industrial facility. If a manifold is involved, inlet attachment FS could be a separate piece to the manifold or they could be of one piece.

Figure 3:
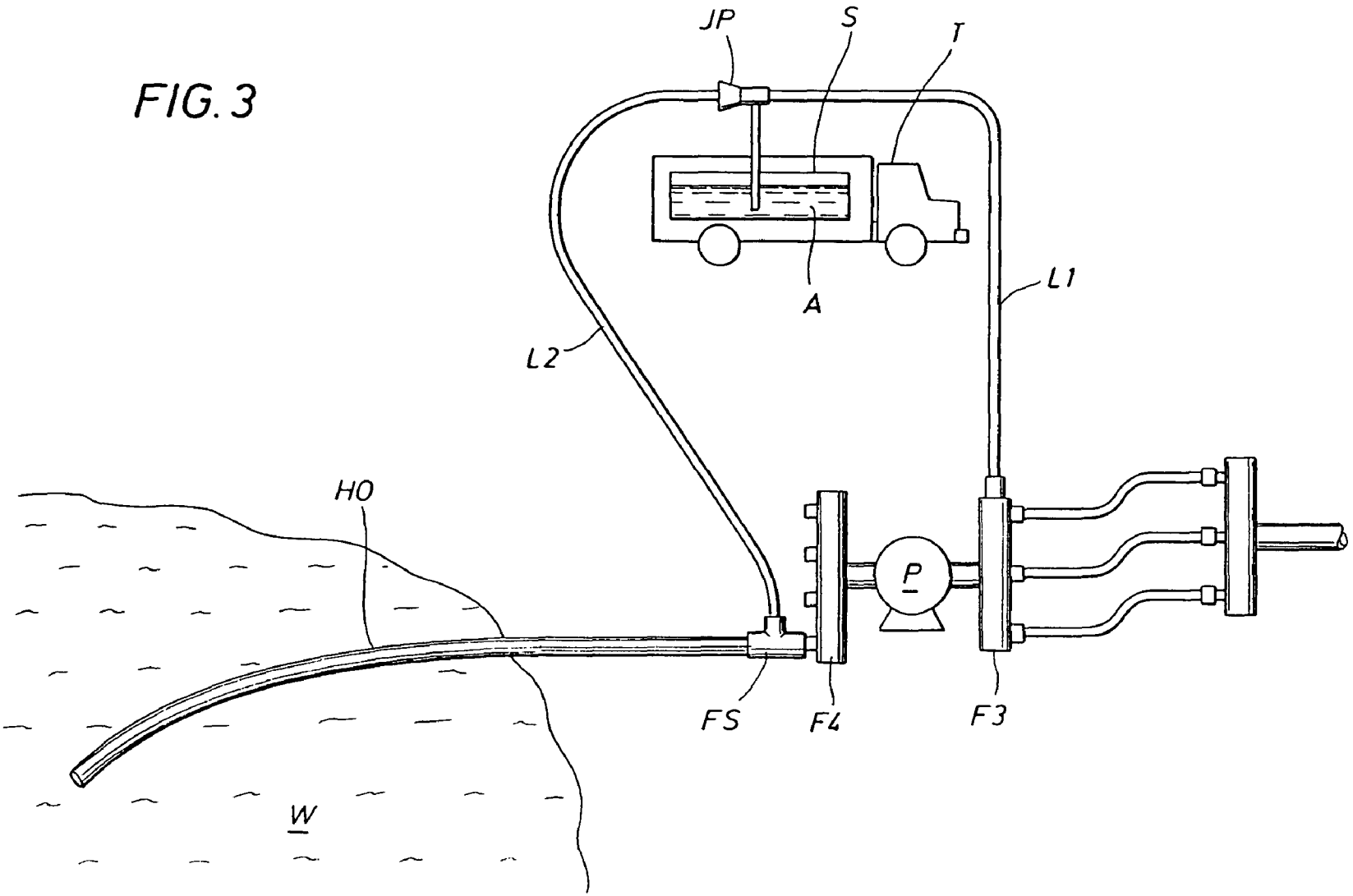
FIG. 3 illustrates an alternate embodiment of the instant invention.

FIG. 3 illustrates an alternate embodiment where a suction side fitting FS for an around-the-pump system is shown structured to be attached to an inlet of a fitting F4 a on standard pump P.

Figure 4:
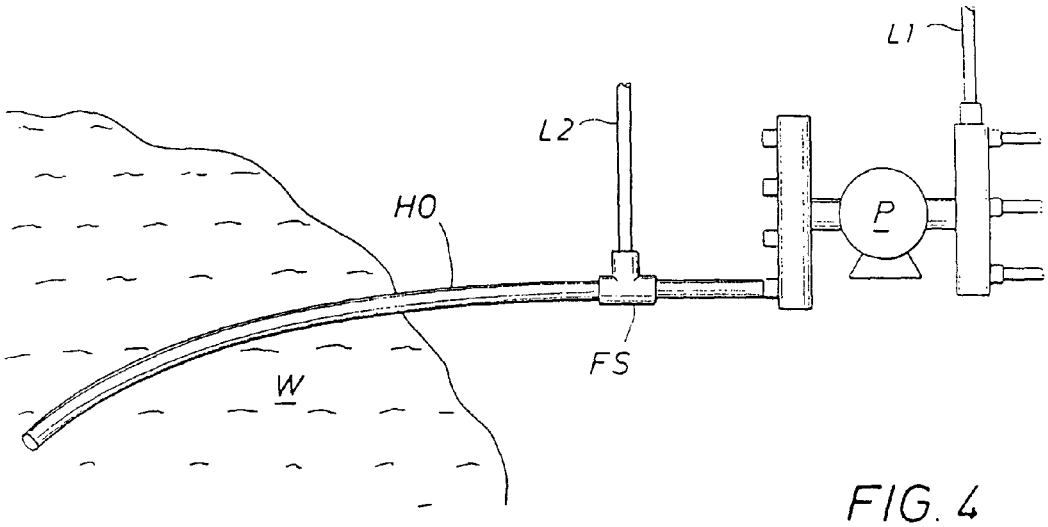
FIG. 4 illustrates in part another alternate embodiment of the instant invention.

FIG. 4 illustrates a still further alternate embodiment where a suction side fitting FS is shown attached in a line, designated as HO, which might in practice be made up of a plurality of lines. FIG. 3 and FIG. 4 both indicate that line HO may be drawing water from a pond or body of water such as an ocean.

Figure 5:
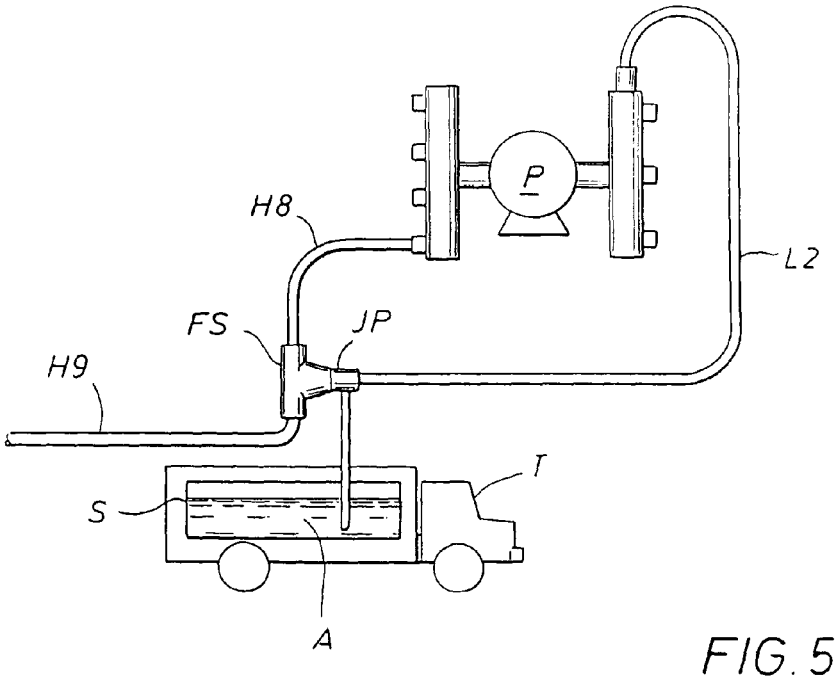
FIG. 5 illustrates in part a further alternate embodiment of the instant invention.

FIG. 5 illustrates a still further alternate embodiment of the instant invention. FIG. 5 illustrates that fitting FS for communicating additive into an around-the-pump line could be structured to be attached to or at the outlet of a jet pump JP, (which alternately, as discussed earlier, could be some other type of pump.)

In operation, a coordinator for operations at an emergency would line up a source of water additives such as one or more of a series of tanks on trailers brought in by a truck. A pump would be located of the requisite size, that is of at least 2000 or greater gpm, and brought to an appropriate location. Lines would be set up from a reservoir of water to the pump and from the pump to conduits leading to the emergency at the facility.

Preferably the truck with the tank or source of additive, such as a foam concentrate, would be fitted with one or more jet pumps. An around-the-pump line, such as a 2½ inch hose, would be attached to a discharge outlet fitting of the pump. This line would be preferably attached to the inlet of the jet pump. A line from the outlet of the jet pump (or the outlet itself) will be attached to a suction inlet fitting on a line leading to a suction side of the pump. Such a suction inlet fitting may have been pre-installed on a fitting at the outlet of a pipe or line leading from the reservoir. Alternately, a suction inlet fitting may be brought to the job and inserted in the line, at a position at or from the reservoir to a position at or from the suction side of the pump. The pump will be started in order to pump water from the reservoir to the facility at the target pressure, such as 150 psi. The source of additive, such as, foam concentrate, will be proportioned or metered to add the appropriate amount into the water line, such as 1% or 3% or 6% for example, through the around-the-pump line.

The foregoing description of preferred embodiments of the invention is presented for purposes of illustration and description, and is not intended to be exhaustive or to limit the invention to the precise form or embodiment disclosed. The description was selected to best explain the principles of the invention and their practical application to enable others skilled in the art to best utilize the invention in various embodiments. Various modifications as are best suited to the particular use are contemplated. It is intended that the scope of the invention is not to be limited by the specification, but to be defined by the claims set forth below.

What is claimed is:

1. A fire fighting method, comprising:

pumping at least 2000 gpm water from a large water reservoir toward an industrial hazard using a standard pump having a water manifold inlet but no special approximately 2½ inch inlet; and adding, in an around-the-pump system, at least one water additive from a water additive source to the pumped water through a fitting at least initially separate from the standard pump, the fitting established on a suction side of the pump upstream of the pump water manifold inlet and in fluid communication between a reservoir outlet and the suction side.

2. The method of claim 1 including adding the at least one water additive through the fitting located between the source of water additive and the suction side of the pump and adding the at least one water additive into a line located between the reservoir outlet and the suction side of the pump.

3. The system of claim 1 including locating the fitting at a reservoir outlet.

4. The system of claim 1 including locating the fitting at a suction side of the pump.

5. The method of claim 1 including locating the fitting in a line leading from the reservoir outlet to the suction side of the pump.

6. The method of claim 1 wherein the around-the-pump system includes porting, through a line established on a discharge side of the pump, at least a portion of water from the discharge side to the suction side of the pump.

7. The method of claim 6 wherein the porting includes porting through a jet pump in fluid communication with the source of water additive.

8. The method of claim 1 wherein the water additive includes foam concentrate.

9. A fire fighting system, comprising;

a large water reservoir;

an at least 2000 gpm standard pump having a water manifold inlet approximately 2½ inch inlet;

a source of water additive; and a fitting at least initially separate from the pump and attached between and adapted for fluid communication with 1) a reservoir outlet and a suction side of the pump and 2) the water additive source and the suction side of the pump wherein the fitting is established on a suction side of the pump upstream of the pump water manifold inlet.

10. The apparatus of claim 9 with the fitting structured to provide an inlet for a water additive line from the additive source.

11. The apparatus of claim 9 wherein the fitting is adapted to attach to a reservoir outlet.

12. The apparatus of claim 9 wherein the fitting is adapted to attach to a suction side of the pump.

13. The system of claim 9 wherein the fitting is adapted to attach in a line located between the reservoir outlet and the suction side of the pump.

14. The apparatus of claim 9 wherein the fitting is adapted to attach to a jet pump outlet, the jet pump in fluid communication with a source of water additive.

15. The apparatus system of claim 9 wherein the water additive includes foam concentrate.

16. A fire fighting system, comprising;

a large water reservoir;

an at least 2000 gpm standard pump having a water manifold inlet but no special approximately 2½ inch inlet;

a source of water additive; and means separate from the pump for connecting an around-the-pump additive supply line with the suction side of the pump, the connecting means established on a suction side of the pump upstream of the pump water manifold inlet.

17. A fire fighting system method, comprising;

attaching at least one line for fluid communication of water from a large reservoir to an at least 2000 gpm standard pump having a water manifold inlet tut no special approximately 2½ inch inlet;

attaching at leak one around-the-pump line for fluid communication of output from a discharge side of the pump to a suction side of the pump;

attaching at least one fitting providing for fluid communication through the around-the-pump line to the suction side of the pump wherein the fitting is established on the suction side of the pump upstream of the pump water manifold inlet.

* * * * *